US010553176B2

(12) United States Patent
Xiong et al.

(10) Patent No.: US 10,553,176 B2
(45) Date of Patent: Feb. 4, 2020

(54) DISPLAY DRIVE CIRCUIT, DISPLAY DEVICE AND METHOD FOR DRIVING THE SAME

(71) Applicants: BOE Technology Group Co., Ltd., Beijing (CN); Chongqing BOE Optoelectronics Technology Co., Ltd., Chongqing (CN)

(72) Inventors: Lijun Xiong, Beijing (CN); Zhi Zhang, Beijing (CN); Heecheol Kim, Beijing (CN); Xiuzhu Tang, Beijing (CN); Shuai Chen, Beijing (CN); Jingpeng Zhao, Beijing (CN); Xing Dong, Beijing (CN); Xiaolong Liu, Beijing (CN); Gang Chen, Beijing (CN); Yanli Zhao, Beijing (CN)

(73) Assignees: BOE Technology Group Co., Ltd., Beijing (CN); Chongqing BOE Optoelectronics Technology Co., Ltd., Chongqing (CN)

( * ) Notice: Subject to any disclaimer, the term of this patent is extended or adjusted under 35 U.S.C. 154(b) by 49 days.

(21) Appl. No.: 16/006,335

(22) Filed: Jun. 12, 2018

(65) Prior Publication Data

US 2019/0057668 A1 Feb. 21, 2019

(30) Foreign Application Priority Data

Aug. 15, 2017 (CN) ..... 2017 1 0696199

(51) Int. Cl.
*G09G 3/36* (2006.01)
*G09G 3/3266* (2016.01)

(52) U.S. Cl.
CPC ..... *G09G 3/3696* (2013.01); *G09G 3/3266* (2013.01); *G09G 3/3677* (2013.01); *G09G 2310/0289* (2013.01); *G09G 2310/08* (2013.01); *G09G 2320/041* (2013.01); *G09G 2330/021* (2013.01)

(58) Field of Classification Search
None
See application file for complete search history.

(56) References Cited

U.S. PATENT DOCUMENTS 9,934,753 B2 * 4/2018 Nam ..... G01K 1/20
2007/0085806 A1 * 4/2007 Moon ..... G09G 3/3611 345/98
2009/0278832 A1 * 11/2009 Cho ..... G09G 3/3648 345/211

(Continued)

*Primary Examiner* — Duane N Taylor, Jr.
(74) *Attorney, Agent, or Firm* — Arent Fox LLP; Michael Fainberg

(57) ABSTRACT

The disclosure discloses a display drive circuit, a display device, and a method for driving the same, where the display drive circuit includes a control circuit arranged between a power supply management circuit and a level conversion circuit, and the control circuit is configured to boost a standard gate turn-on voltage signal provided by the power supply management circuit, and to generate and then output a higher gate turn-on voltage signal to the level conversion circuit, upon determining that an ambient temperature is below a set temperature, and/or an output of a gate drive circuit of a display panel is abnormal, so that the level conversion circuit generates and then outputs a corresponding gate drive signal at higher voltage.

19 Claims, 5 Drawing Sheets

(56) References Cited

U.S. PATENT DOCUMENTS

| | | | | |
|---|---|---|---|---|
| 2012/0169744 | A1* | 7/2012 | Seo | G09G 3/3696 345/519 |
| 2014/0111499 | A1* | 4/2014 | Jang | G09G 3/3696 345/212 |

* cited by examiner

DISPLAY DRIVE CIRCUIT, DISPLAY DEVICE AND METHOD FOR DRIVING THE SAME

CROSS-REFERENCE TO RELATED APPLICATION

This Application claims priority to Chinese Patent Application No. 201710696199.X, filed on Aug. 15, 2017, the content of which is incorporated by reference in the entirety.

TECHNICAL FIELD

This disclosure relates to the field of display technologies, and particularly to a display drive circuit, a display device, and a method for driving the same.

DESCRIPTION OF THE RELATED ART

At present, a Liquid Crystal Display (LCD) panel, and other flat panel display devices typically include a gate drive circuit, i.e. Gate Driver on Array (GOA), arranged on an array substrate to facilitate a design thereof with a narrow bezel at a low cost. However the characteristic of a Thin Film Transistor (TFT) in the GOA drive circuit may vary at low temperature, so that a value of a turn-on current (Ion) becomes smaller, and the TFT fails to be turned on, thus easily resulting in abnormal startup, etc.

In a conventional solution to address abnormal startup at low temperature, simply the drive voltage of the GOA is raised, or the value of the Ion is raised by improving the characteristic of the TFT. However power consumption of the display panel may be increased due to the higher drive voltage; and a turn-off current (Ioff) may be raised along with the increase of the value of the Ion, so that a leakage current is so large that the gate drive circuit fails to output, thus resulting in Abnormal Display (AD), etc.

SUMMARY

Embodiments of the disclosure provide a display drive circuit, a display device, and a method for driving the same.

In an aspect, embodiments of the disclosure provide a display drive circuit including: a power supply management circuit, a control circuit connected with the power supply management circuit, and a level conversion circuit connected with the control circuit, wherein: the power supply management circuit is configured to provide a standard gate turn-on voltage signal; the control circuit is configured to output a received standard gate turn-on voltage signal directly upon determining that an ambient temperature is not below a set temperature and a gate drive circuit of a display panel is outputting normally, or to boost the received standard gate turn-on voltage signal and to generate and then output a higher gate turn-on voltage signal, upon determining that the ambient temperature is below the set temperature and/or the gate drive circuit of the display panel is outputting abnormally; and the level conversion circuit is configured to generate and then output a gate drive signal at standard voltage upon reception of the standard gate turn-on voltage signal, or to generate and then output a gate drive signal at higher voltage upon reception of the higher gate turn-on voltage signal.

In some embodiments, in the display drive circuit above according to the embodiments of the disclosure, the control circuit includes an output detection circuit, a temperature detection circuit, a logic circuit connected respectively with the output detection circuit and the temperature detection circuit, and a boost judgment circuit connected respectively with the logic circuit, the power supply management circuit, and the level conversion circuit, wherein: the output detection circuit is configured to output a first enable signal at a first level upon detecting an abnormal output of the gate drive circuit of the display panel, or to output a first enable signal at a second level upon detecting a normal output of the gate drive circuit of the display panel; the temperature detection circuit is configured to output a second enable signal at the first level upon detecting that the ambient temperature is below the set temperature, or to output a second enable signal at the second level upon detecting that the ambient temperature is not below the set temperature; the logic circuit is configured to output a third enable signal at the first level upon reception of the first enable signal at the first level and/or the second enable signal at the first level, or to output a third enable signal at the second level upon reception of the first enable signal at the second level and the second enable signal at the second level; and the boost judgment circuit is configured to output the received standard gate turn-on voltage signal directly upon reception of the third enable signal at the second level, or to boost the received standard gate turn-on voltage signal and to generate and then output the higher gate turn-on voltage signal upon reception of the third enable signal at the first level.

In some embodiments, in the display drive circuit above according to the embodiments of the disclosure, the temperature detection circuit includes a first resistor, a second resistor, a thermistor, and a first switch transistor, wherein: one terminal of the first resistor is connected with a power supply signal terminal, and the other terminal of the first resistor is connected with a first node; one terminal of the second resistor is connected with the first node, and the other terminal of the second resistor is grounded; one terminal of the thermistor is connected with the first node, and the other terminal of the thermistor is connected with a gate of the first switch transistor; a source of the first switch transistor is connected with the power supply signal terminal, and a drain of the first switch transistor is connected with the logic circuit; and the first level is a high level, and the second level is a low level; and a resistance of the thermistor decreases as a temperature decreases.

In some embodiments, in the display drive circuit above according to the embodiments of the disclosure, the logic circuit includes a first diode, a second diode, and a third resistor, wherein: an input terminal of the first diode is connected with the temperature detection circuit, and an output terminal of the first diode is connected with the boost judgment circuit; an input terminal of the second diode is connected with the output detection circuit, and an output terminal of the second diode is connected with the boost judgment circuit; and one terminal of the third resistor is connected respectively with the output terminal of the first diode and the output terminal of the second diode, and the other terminal of the third resistor is grounded.

In some embodiments, in the display drive circuit above according to the embodiments of the disclosure, the boost judgment circuit includes a second switch transistor, a third switch transistor, and a boost circuit, wherein: a gate of the second switch transistor is connected with the logic circuit, a source of the second switch transistor is connected with the power supply management circuit, and a drain of the second switch transistor is connected with an input terminal of the boost circuit; and an output terminal of the boost circuit is connected with the level conversion circuit; a gate of the third switch transistor is connected with the logic circuit, a source of the third switch transistor is connected with the power supply management circuit, and a drain of the third switch transistor is connected with the level conversion circuit; and the first level is a low level, the second level is a high level, the second switch transistor is a P-type transistor, and the third switch transistor is an N-type transistor; or the first level is a high level, the second level is a low level, the second switch transistor is an N-type transistor, and the third switch transistor is a P-type transistor.

In some embodiments, in the display drive circuit above according to the embodiments of the disclosure, the boost judgment circuit includes a second switch transistor, a third switch transistor, an inverter, and a boost circuit, wherein: a gate of the second switch transistor is connected with the logic circuit, a source of the second switch transistor is connected with the power supply management circuit, and a drain of the second switch transistor is connected with an input terminal of the boost circuit, and an output terminal of the boost circuit is connected with the level conversion circuit; and a gate of the third switch transistor is connected with an output terminal of the inverter, a source of the third switch transistor is connected with the power supply management circuit, and a drain of the third switch transistor is connected with the level conversion circuit, and an input terminal of the inverter is connected with the logic circuit.

In some embodiments, in the display drive circuit above according to the embodiments of the disclosure, the inverter includes a fourth switch transistor and a fifth switch transistor, wherein: a gate of the fourth switch transistor and a gate of the fifth switch transistor are connected respectively with the logic circuit; a source of the fourth switch transistor is connected with the power supply signal terminal, and a drain of the fourth switch transistor is connected with the gate of the third switch transistor; a source of the fifth switch transistor is grounded, and a drain of the fifth switch transistor is connected with the gate of the third switch transistor; and the fourth switch transistor is a P-type transistor, and the fifth switch transistor is an N-type transistor.

In some embodiments, in the display drive circuit above according to the embodiments of the disclosure, the display drive circuit further includes a timing controller in which the output detection circuit is arranged; and the timing controller is connected with an output terminal at a last level of the gate drive circuit of the display panel.

In some embodiments, in the display drive circuit above according to the embodiments of the disclosure, each gate drive signal at least includes one of a clock signal, a high-level signal, and a frame start signal.

In another aspect, the embodiments of the disclosure further provide a display device including a display drive circuit, and a display panel including a gate drive circuit; wherein the display drive circuit includes a power supply management circuit, a control circuit connected with the power supply management circuit, and a level conversion circuit connected with the control circuit, wherein: the power supply management circuit is configured to provide a standard gate turn-on voltage signal; the control circuit is configured to output a received standard gate turn-on voltage signal directly upon determining that an ambient temperature is not below a set temperature and a gate drive circuit of a display panel is outputting normally, or to boost the received standard gate turn-on voltage signal and to generate and then output a higher gate turn-on voltage signal, upon determining that the ambient temperature is below the set temperature and/or the gate drive circuit of the display panel is outputting abnormally; and the level conversion circuit is configured to generate and then output a gate drive signal at standard voltage upon reception of the standard gate turn-on voltage signal, or to generate and then output a gate drive signal at higher voltage upon reception of the higher gate turn-on voltage signal.

In some embodiments, in the display device above according to the embodiments of the disclosure, the control circuit includes an output detection circuit, a temperature detection circuit, a logic circuit connected respectively with the output detection circuit and the temperature detection circuit, and a boost judgment circuit connected respectively with the logic circuit, the power supply management circuit, and the level conversion circuit, wherein: the output detection circuit is configured to output a first enable signal at a first level upon detecting an abnormal output of the gate drive circuit of the display panel, or to output a first enable signal at a second level upon detecting a normal output of the gate drive circuit of the display panel; the temperature detection circuit is configured to output a second enable signal at the first level upon detecting that the ambient temperature is below the set temperature, or to output a second enable signal at the second level upon detecting that the ambient temperature is not below the set temperature; the logic circuit is configured to output a third enable signal at the first level upon reception of the first enable signal at the first level and/or the second enable signal at the first level, or to output a third enable signal at the second level upon reception of the first enable signal at the second level and the second enable signal at the second level; and the boost judgment circuit is configured to output the received standard gate turn-on voltage signal directly upon reception of the third enable signal at the second level, or to boost the received standard gate turn-on voltage signal and to generate and then output the higher gate turn-on voltage signal upon reception of the third enable signal at the first level.

In some embodiments, in the display device above according to the embodiments of the disclosure, the temperature detection circuit includes a first resistor, a second resistor, a thermistor, and a first switch transistor, wherein: one terminal of the first resistor is connected with a power supply signal terminal, and the other terminal of the first resistor is connected with a first node; one terminal of the second resistor is connected with the first node, and the other terminal of the second resistor is grounded; one terminal of the thermistor is connected with the first node, and the other terminal of the thermistor is connected with a gate of the first switch transistor; a source of the first switch transistor is connected with the power supply signal terminal, and a drain of the first switch transistor is connected with the logic circuit; and the first level is a high level, and the second level is a low level; and a resistance of the thermistor decreases as a temperature decreases.

In some embodiments, in the display device above according to the embodiments of the disclosure, the logic circuit includes a first diode, a second diode, and a third resistor, wherein: an input terminal of the first diode is connected with the temperature detection circuit, and an output terminal of the first diode is connected with the boost judgment circuit; an input terminal of the second diode is connected with the output detection circuit, and an output terminal of the second diode is connected with the boost judgment circuit; and one terminal of the third resistor is connected respectively with the output terminal of the first diode and the output terminal of the second diode, and the other terminal of the third resistor is grounded.

In some embodiments, in the display device above according to the embodiments of the disclosure, the boost judgment circuit includes a second switch transistor, a third switch transistor, and a boost circuit, wherein: a gate of the second switch transistor is connected with the logic circuit, a source of the second switch transistor is connected with the power supply management circuit, and a drain of the second switch transistor is connected with an input terminal of the boost circuit; and an output terminal of the boost circuit is connected with the level conversion circuit; a gate of the third switch transistor is connected with the logic circuit, a source of the third switch transistor is connected with the power supply management circuit, and a drain of the third switch transistor is connected with the level conversion circuit; and the first level is a low level, the second level is a high level, the second switch transistor is a P-type transistor, and the third switch transistor is an N-type transistor; or the first level is a high level, the second level is a low level, the second switch transistor is an N-type transistor, and the third switch transistor is a P-type transistor.

In some embodiments, in the display device above according to the embodiments of the disclosure, the boost judgment circuit includes a second switch transistor, a third switch transistor, an inverter, and a boost circuit, wherein: a gate of the second switch transistor is connected with the logic circuit, a source of the second switch transistor is connected with the power supply management circuit, and a drain of the second switch transistor is connected with an input terminal of the boost circuit, and an output terminal of the boost circuit is connected with the level conversion circuit; and a gate of the third switch transistor is connected with an output terminal of the inverter, a source of the third switch transistor is connected with the power supply management circuit, and a drain of the third switch transistor is connected with the level conversion circuit, and an input terminal of the inverter is connected with the logic circuit.

In some embodiments, in the display device above according to the embodiments of the disclosure, the inverter includes a fourth switch transistor and a fifth switch transistor, wherein: a gate of the fourth switch transistor and a gate of the fifth switch transistor are connected respectively with the logic circuit; a source of the fourth switch transistor is connected with the power supply signal terminal, and a drain of the fourth switch transistor is connected with the gate of the third switch transistor; a source of the fifth switch transistor is grounded, and a drain of the fifth switch transistor is connected with the gate of the third switch transistor; and the fourth switch transistor is a P-type transistor, and the fifth switch transistor is an N-type transistor.

In some embodiments, in the display device above according to the embodiments of the disclosure, the display drive circuit further includes a timing controller in which the output detection circuit is arranged; and the timing controller is connected with an output terminal at a last level of the gate drive circuit of the display panel.

In some embodiments, in the display device above according to the embodiments of the disclosure, each gate drive signal at least includes one of a clock signal, a high-level signal, and a frame start signal.

In still another aspect, the embodiment of the disclosure further provide a method for driving the display device above, the method including: determining, by the display drive circuit, whether the ambient temperature is below the set temperature, and determining whether the gate drive circuit of the display panel is outputting normally; generating, by the display drive circuit, the gate drive signal at the standard voltage according to the standard gate turn-on voltage signal, and outputting the gate drive signal at the standard voltage to the gate drive circuit of the display panel, upon determining that the ambient temperature is not below the set temperature and the gate drive circuit of the display panel is outputting normally; or boosting, by the display drive circuit, the standard gate turn-on voltage signal, and generating the higher gate turn-on voltage signal, and generating the gate drive signal at the higher voltage according to the higher gate turn-on voltage signal, and outputting the gate drive signal at the higher voltage to the gate drive circuit of the display panel, upon determining that the ambient temperature is below the set temperature, and/or the gate drive circuit of the display panel is outputting abnormally.

BRIEF DESCRIPTION OF THE DRAWINGS

In order to make the technical solutions according to embodiments of the disclosure more apparent, the drawings to which a description of the embodiments refers will be briefly introduced below, and apparently the drawings to be described below are merely illustrative of some of the embodiments of the disclosure, and those ordinarily skilled in the art can derive from these drawings other drawings without any inventive effort.

DETAILED DESCRIPTION OF THE EMBODIMENTS

Particular implementations of the display drive circuit, the display device, and the method for driving the same according to the embodiments of the disclosure will be described below in details with reference to the drawings.

Figure 1:
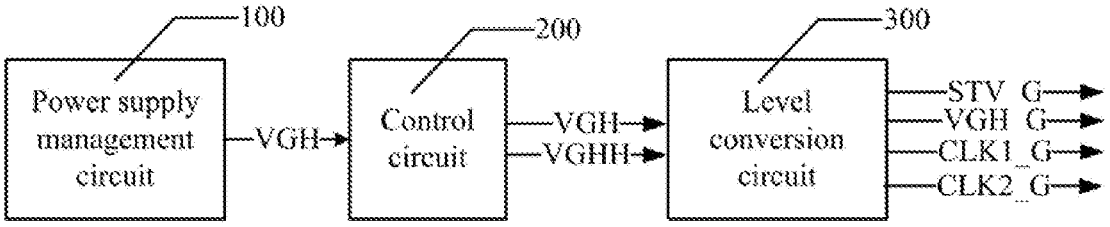
FIG. 1 is a first schematic structural diagram of a display drive circuit according to the embodiments of the disclosure.

Embodiments of the disclosure provides a display drive circuit as illustrated in FIG. 1 including: a power supply management circuit 100, a control circuit 200 connected with the power supply management circuit 100, and a level conversion circuit 300 connected with the control circuit 200.

The power supply management circuit 100 is configured to provide a standard gate turn-on voltage signal VGH.

The control circuit 200 is configured to output a received standard gate turn-on voltage signal VGH directly upon determining that an ambient temperature is not below a set temperature, and a gate drive circuit GOA of a display panel is outputting normally; or to boost the received standard gate turn-on voltage signal VGH, and to generate and then output a higher gate turn-on voltage signal VGHH, upon determining that the ambient temperature is below the set temperature, and/or the gate drive circuit GOA of the display panel is outputting abnormally.

The level conversion circuit 300 is configured to generate and then output a gate drive signal at standard voltage upon reception of the standard gate turn-on voltage signal VGH;

or to generate and then output a gate drive signal at higher voltage upon reception of the higher gate turn-on voltage signal VGHH.

In some embodiments, each gate drive signal at least includes one of a clock signal, a high-level signal, and a frame start signal. For example, as illustrated in FIG. 1, the gate drive signal includes a pair of clock signals CLK1_G and CLK2_G, a high-level signal VGH_G, and a frame start signal STV_G.

It shall be noted that in the display drive circuit above according to the embodiments of the disclosure, the gate drive signal includes the frame start signal STV_G, and a pair of clock signals, for example, but in a practical application, the gate drive signal can include a plurality of frame start signals STV_G, and a plurality of pairs of clock signals, and a pair of clock signals can include 2, 3, 4, . . . , clock signals as needed.

In the display drive circuit above according to the embodiments of the disclosure, the control circuit 200 is further arranged between the power supply management circuit 100 and the level conversion circuit 300, and the control circuit 200 can boost the standard gate turn-on voltage signal VGH provided by the power supply management circuit 100, and generate and then output the higher gate turn-on voltage signal VGHH to the level conversion circuit 300, upon determining that the ambient temperature is below the set temperature, and/or the output of the gate drive circuit of the display panel is abnormal, so that the level conversion circuit 300 generates and then outputs a corresponding gate drive signal at the higher voltage, and in this way, when the detection result shows that the gate drive circuit is operating in a harsh low-temperature environment, the drive voltage of the gate drive circuit is raised so that it can be started and operate normally to thereby enable the display panel to operate normally. The control circuit 200 outputs the standard gate turn-on voltage signal VGH provided by the power supply management circuit 100 to the level conversion circuit 300 directly upon determining that the ambient temperature is not below the set temperature, and the output of the gate drive circuit of the display panel is normal, so that the level conversion circuit 300 generates and then outputs a corresponding gate drive signal at the standard voltage, and in this way, when the detection result shows that the gate drive circuit operates normally, the gate drive circuit is brought into operation at the drive voltage with lower power consumption to thereby save power consumption in normal operation. Thus power consumption of the display panel can be saved while guaranteeing normal startup at low temperature.

Figure 2:
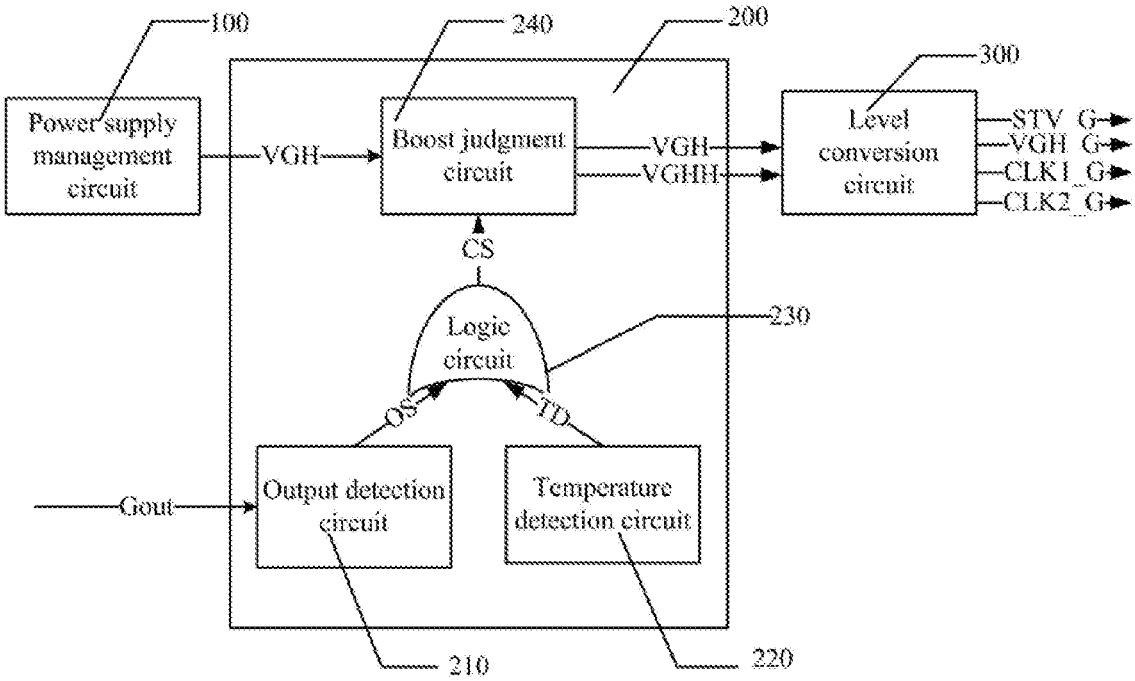
FIG. 2 is a second schematic structural diagram of a display drive circuit according to the embodiments of the disclosure.

In some embodiments, in the display drive circuit above according to the embodiments of the disclosure, in order to detect the ambient temperature, and the output of the gate drive circuit GOA, the control circuit 200 as illustrated in FIG. 2 includes: an output detection circuit 210, a temperature detection circuit 220, a logic circuit 230 connected respectively with the output detection circuit 210 and the temperature detection circuit 220, and a boost judgment circuit 240 connected respectively with the logic circuit 230, the power supply management circuit 100, and the level conversion circuit 300.

The output detection circuit 210 is configured to output a first enable signal OS at a first level upon detecting an abnormal output of the gate drive circuit GOA of the display panel; or to output a first enable signal OS at a second level upon detecting a normal output of the gate drive circuit GOA of the display panel.

The temperature detection circuit 220 is configured to output a second enable signal TD at the first level upon detecting that the ambient temperature is below the set temperature; or to output a second enable signal TD at the second level upon detecting that the ambient temperature is not below the set temperature.

The logic circuit 230 is configured to output a third enable signal CS at the first level upon reception of the first enable signal OS at the first level and/or the second enable signal TD at the first level; or to output a third enable signal CS at the second level upon reception of the first enable signal OS at the second level and the second enable signal TD at the second level.

The boost judgment circuit 240 is configured to output the received standard gate turn-on voltage signal VGH directly upon reception of the third enable signal CS at the second level; or to boost the received standard gate turn-on voltage signal VGH, and to generate and then output the higher gate turn-on voltage signal VGHH upon reception of the third enable signal CS at the first level.

In some embodiments, in the display drive circuit above according to the embodiments of the disclosure, the output detection circuit 210 is connected with a plurality of output terminals of the gate drive circuit GOA of the display panel to detect whether the output Gout of the gate drive circuit GOA is abnormal; or the output detection circuit 210 is connected with some output terminal of the gate drive circuit GOA of the display panel to detect an abnormal output signal at the output terminal to thereby determine whether the entire gate drive circuit GOA is outputting abnormally, although the embodiments of the disclosure will not be limited thereto. In some embodiments, the output detection circuit 210 is only connected with an output terminal at a last level of the gate drive circuit GOA of the display panel, and if an abnormal output signal of the output terminal at the last level is detected, then it will indicate that the entire gate drive circuit GOA is outputting abnormally.

In some embodiments, in the display drive circuit above according to the embodiments of the disclosure, the output detection circuit 210 determines whether the gate drive circuit GOA is abnormal by comparing an obtained output Gout of the gate drive circuit GOA with a voltage value of a standard gate scan signal, and for example, if the obtained output Gout of the gate drive circuit GOA is 18V, and the standard gate scan signal is 22 V, where the difference between them lies out of a set range, then it will be determined that the output Gout of the gate drive circuit GOA is abnormal.

In some embodiments, in the display drive circuit above according to the embodiments of the disclosure, the set temperature stored in the temperature detection circuit 220 is typically a trustable reference low temperature, which is generally −20□.

Figure 3:
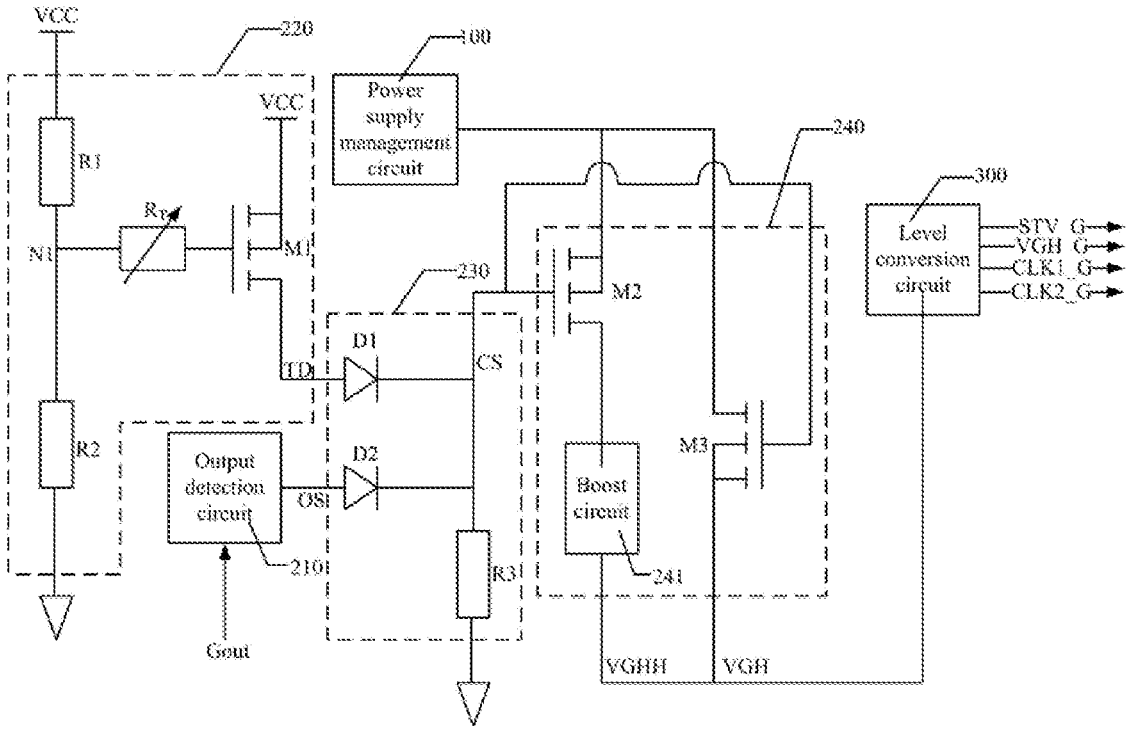
FIG. 3 is a third schematic structural diagram of a display drive circuit according to the embodiments of the disclosure.

In some embodiments, in the display drive circuit above according to the embodiments of the disclosure, the temperature detection circuit 220 as illustrated in FIG. 3 includes: a first resistor R1, a second resistor R2, a thermistor $R_T$, and a first switch transistor M1, where: one terminal of the first resistor R1 is connected with a power supply signal terminal VCC, and the other terminal of the first resistor R1 is connected with a first node N1; one terminal of the second resistor R2 is connected with the first node N1, and the other terminal of the second resistor R2 is grounded; one terminal of the thermistor $R_T$ is connected with the first node N1, and the other terminal of the thermistor $R_T$ is connected with a gate of the first switch transistor M1; a source of the first switch transistor M1 is connected with the power supply signal terminal VCC, and a drain of the first switch transistor M1 is connected with the logic circuit 230; and the first level is a high level, and the second level is a low level; and a resistance of the thermistor $R_T$ decreases as the temperature decreases.

In some embodiments, in the display drive circuit above according to the embodiments of the disclosure, the power supply signal terminal VCC, which are connected with the first resistor R1, and the source of the first switch transistor M1 in the temperature detection circuit 220, and the power supply management circuit 100 are independent of each other, so that the temperature detection circuit 220 can detect the ambient temperature before the power supply management circuit 100 is started.

In some embodiments, in the display drive circuit above according to the embodiments of the disclosure, the first level of the respective enable signals provided in the control circuit 200 is typically a high level, and the second level thereof is a low level; or vice versa. For example, the temperature detection circuit 220 outputs the second enable signal TD at the high level upon detecting that the ambient temperature is below −20□, or outputs the second enable signal TD at the low level upon detecting that the ambient temperature is above −20° C. After the output of the last row of gate drive circuit in the display panel is fed to the output detection circuit 210, the output detection circuit outputs the first enable signal OS at the high level upon determining that the output at the last row is abnormal, or outputs the first enable signal OS at the low level upon determining that the output at the last row is normal, so that abnormal startup due to an inherent difference of the display panel approaching the critical temperature (−20° C.) can be prevented. The logic circuit 230 is actually an OR gate, and outputs the third enable signal CS as a result of a logic operation as depicted in Table 1 below, upon reception of the first enabling signal OS and the second enabling signal TD.

TABLE 1

| | | t1 | t2 | t3 | t4 |
|---|---|---|---|---|---|
| Input | TD | 1 | 1 | 0 | 0 |
| | OS | 0 | 1 | 1 | 0 |
| Output | CS | 1 | 1 | 1 | 0 |

In some embodiments, in the display drive circuit above according to the embodiments of the disclosure, the logic circuit 230 as illustrated in FIG. 3 includes: a first diode D1, a second diode D2, and a third resistor R3, where: an input terminal of the first diode D1 is connected with the temperature detection circuit 220, and an output terminal of the first diode D1 is connected with the boost judgment circuit 240; an input terminal of the second diode D2 is connected with the output detection circuit 210, and an output terminal of the second diode D2 is connected with the boost judgment circuit 240; and one terminal of the third resistor R3 is connected respectively with the output terminal of the first diode D1, and the output terminal of the second diode D2, and the other terminal of the third resistor R3 is grounded.

In some embodiments, in the display drive circuit above according to the embodiments of the disclosure, the boost judgment circuit 240 as illustrated in FIG. 3 includes: a second switch transistor M2, a third switch transistor M3, and a boost circuit 241, where: a gate of the second switch transistor M2 is connected with the logic circuit 230, a source of the second switch transistor M2 is connected with the power supply management circuit 100, and a drain of the second switch transistor M2 is connected with an input terminal of the boost circuit 241, and an output terminal of the boost circuit 241 is connected with the level conversion circuit 300.

A gate of the third switch transistor M3 is connected with the logic circuit 230, a source of the third switch transistor M3 is connected with the power supply management circuit 100, and a drain of the third switch transistor M3 is connected with the level conversion circuit 300.

When the first level is a low level, and the second level is a high level, the second switch transistor M2 is a P-type transistor, and the third switch transistor M3 is an N-type transistor, that is, when the third enable signal CS is at a low level, the second switch transistor M2 is turned on, the third switch transistor M3 is turned off, the standard gate turn-on voltage signal VGH provided by the power supply management circuit 100 is input to the input terminal of the boost circuit 241, and the boost circuit 241 boosts the standard gate turn-on voltage signal VGH to the higher gate turn-on voltage signal VGHH, and then outputs the higher gate turn-on voltage signal VGHH; and when the third enable signal CS is at a high level, the third switch transistor M3 is turned on, and the second switch transistor M2 is turned off, and at this time, the boost circuit 241 does not operate to save power consumption, and the standard gate turn-on voltage signal VGH provided by the power supply management circuit 100 is input directly to the level conversion circuit 300.

When the first is a high level, and the second level is a low level, the second switch transistor M2 is an N-type transistor, and the third switch transistor M3 is a P-type transistor, that is, when the third enable signal CS is at a high level, the second switch transistor M2 is turned on, the third switch transistor M3 is turned off, the standard gate turn-on voltage signal VGH provided by the power supply management circuit 100 is input to the input terminal of the boost circuit 241, and the boost circuit 241 boosts the standard gate turn-on voltage signal VGH to the higher gate turn-on voltage signal VGHH, and then outputs the higher gate turn-on voltage signal VGHH; and when the third enable signal CS is at a low level, the third switch transistor M3 is turned on, and the second switch transistor M2 is turned off, and at this time, the boost circuit 241 does not operate to save power consumption, and the standard gate turn-on voltage signal VGH provided by the power supply management circuit 100 is input directly to the level conversion circuit 300.

Figure 4:
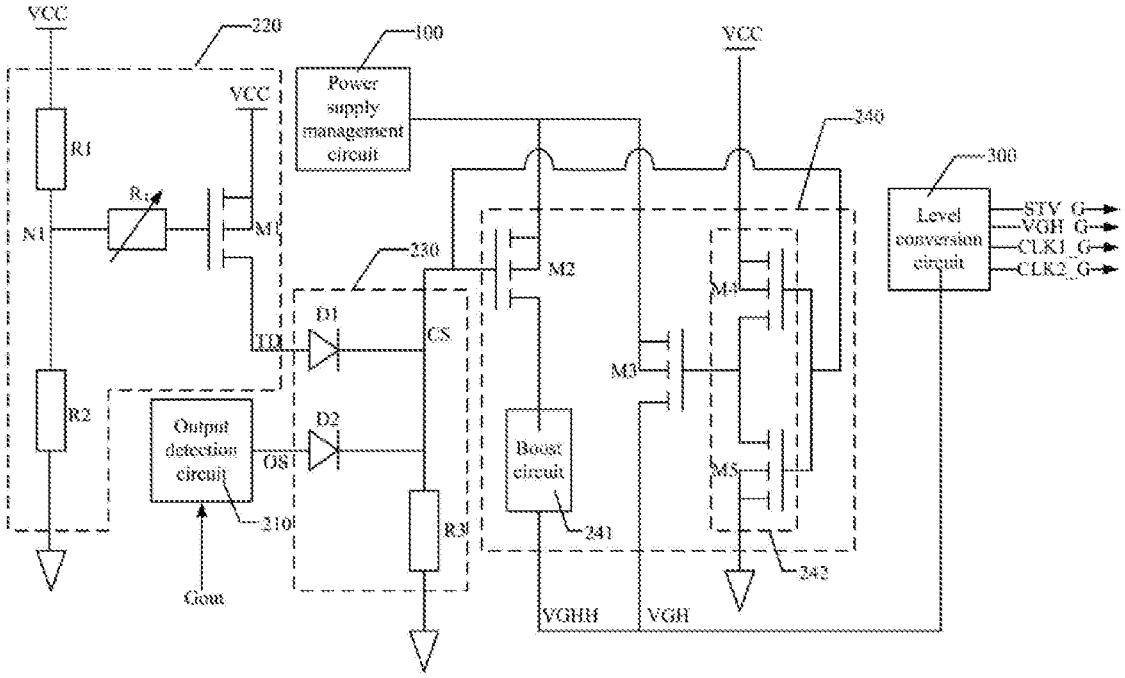
FIG. 4 is fourth schematic structural diagram of a display drive circuit according to the embodiments of the disclosure.

Alternatively in some embodiments, in the display drive circuit above according to the embodiments of the disclosure, the boost judgment circuit 240 as illustrated in FIG. 4 includes: a second switch transistor M2, a third switch transistor M3, an inverter 242, and a boost circuit 241, where: a gate of the second switch transistor M2 is connected with the logic circuit 230, a source of the second switch transistor M2 is connected with the power supply management circuit 100, and a drain of the second switch transistor M2 is connected with an input terminal of the boost circuit 241, and an output terminal of the boost circuit 241 is connected with the level conversion circuit 300; a gate of the third switch transistor M3 is connected with an output terminal of the inverter 242, a source of the third switch transistor M3 is connected with the power supply management circuit 100, and a drain of the third switch transistor M3 is connected with the level conversion circuit 300, and an input terminal of the inverter 242 is connected with the logic circuit 230.

In the boost judgment circuit 240 above as illustrated in FIG. 4, when the first level is a low level, and the second level is a high level, both the second switch transistor M2 and the third switch transistor M3 are P-type transistors, that is, when the third enable signal CS is at a low level, the second switch transistor M2 is turned on, the standard gate turn-on voltage signal VGH provided by the power supply management circuit 100 is input to the input terminal of the boost circuit 241, the boost circuit 241 boosts the standard gate turn-on voltage signal VGH to the higher gate turn-on voltage signal VGHH, and then outputs the higher gate turn-on voltage signal VGHH, voltage at a high level is input to the gate of the third switch transistor M3 through the inverter 242, and the third switch transistor M3 is turned off; and when the third enable signal CS is at a high level, the second switch transistor M2 is turned off, and at this time, the boost circuit 241 does not operate to save power consumption, voltage at a low level is input to the gate of the third switch transistor M3 through the inverter 242, the third switch transistor M3 is turned on, and the standard gate turn-on voltage signal VGH provided by the power supply management circuit 100 is input directly to the level conversion circuit 300.

When the first level is a high level, and the second level is a low level, both the second switch transistor M2 and the third switch transistor M3 are N-type transistors, that is, when the third enable signal CS is at a high level, the second switch transistor M2 is turned on, the standard gate turn-on voltage signal VGH provided by the power supply management circuit 100 is input to the input terminal of the boost circuit 241, the boost circuit 241 boosts the standard gate turn-on voltage signal VGH to the higher gate turn-on voltage signal VGHH, and then outputs the higher gate turn-on voltage signal VGHH, voltage at a low level is input to the gate of the third switch transistor M3 through the inverter 242, and the third switch transistor M3 is turned off; and when the third enable signal CS is at a low level, the second switch transistor M2 is turned off, and at this time, the boost circuit 241 does not operate to save power consumption, voltage at a high level is input to the gate of the third switch transistor M3 through the inverter 242, the third switch transistor M3 is turned on, and the standard gate turn-on voltage signal VGH provided by the power supply management circuit 100 is input directly to the level conversion circuit 300.

In some embodiments, in the display drive circuit above according to the embodiments of the disclosure, the inverter 242 as illustrated in FIG. 4 includes: a fourth switch transistor M4 and a fifth switch transistor M5.

A gate of the fourth switch transistor M4 and a gate of the fifth switch transistor M5 are connected respectively with the logic circuit 230; a source of the fourth switch transistor M4 is connected with the power supply signal terminal VCC, and a drain of the fourth switch transistor M4 is connected with the gate of the third switch transistor M3; a source of the fifth switch transistor M5 is grounded, and a drain of the fifth switch transistor M5 is connected with the gate of the third switch transistor M3; and the fourth switch transistor M4 is a P-type transistor, the fifth switch transistor M5 is an N-type transistor.

When the third enable signal CS is at a high level, the fourth switch transistor M4 is turned off, the fifth switch transistor M5 is turned on, and a low level is input to the gate of the third switch transistor M3; and when the third enable signal CS is at a low level, the fifth switch transistor M5 is turned off, the fourth switch transistor M4 is turned on, and a high level is input to the gate of the third switch transistor M3, so that the level is converted between the high and low levels.

Figure 5:
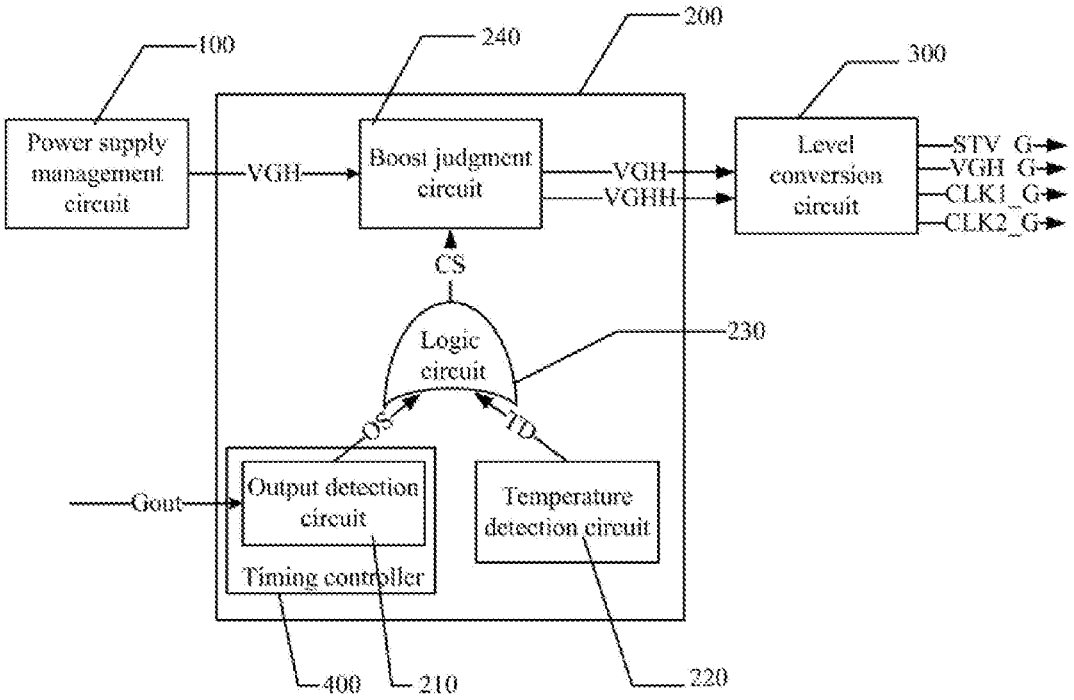
FIG. 5 is fifth schematic structural diagram of a display drive circuit according to the embodiments of the disclosure.

In some embodiments, in the display drive circuit above according to the embodiments of the disclosure, the display drive circuit as illustrated in FIG. 5 further includes a timing controller 400 (TCON) in which the output detection circuit 210 is arranged to thereby enable the display drive circuit to be highly integrated. In some embodiments, the function of the output detection circuit 210 is performed by a Micro Control Circuit (MCU) in the timing controller 400. Furthermore the timing controller 400 is connected with the last level of output terminal of the gate drive circuit GOA of the display panel, so that if the abnormal output signal at the last level of output terminal is detected, then it will indicate that the entire gate drive circuit GOA is outputting abnormally.

In some embodiments, the display drive circuit above according to the embodiments of the disclosure can perform its function through a Printed Circuit Board (PCB), that is, the respective circuits and units in the display drive circuit are arranged on the printed circuit board.

Figure 6:
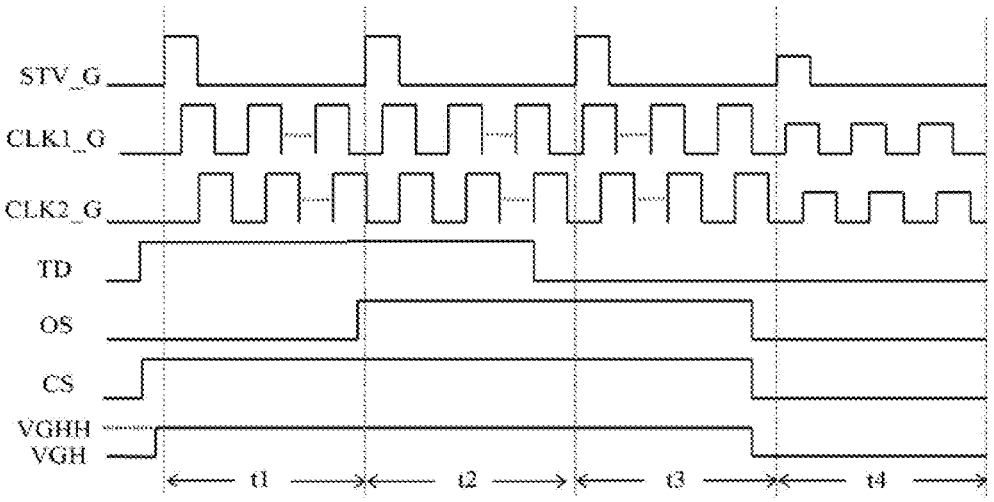
FIG. 6 is a schematic diagram of waveforms of respective signals in a display drive circuit according to the embodiments of the disclosure.

An operating process of the display drive circuit above according to the embodiments of the disclosure will be described below in connection with the schematic diagram of waveforms of the respective signals as illustrated in FIG. 6, where the first level is a high level, and the second level is a low level, for example.

In a first stage t1, the display drive circuit is powered at the power supply signal terminal VCC, and the temperature detection circuit 220 detects the ambient temperature; and for example, the ambient temperature is below −20□, and the resistance of a temperature sensor, i.e., the thermistor $R_T$, is very small, so the first switch transistor M2 is turned on, and outputs the second enable signal TD at a high level. At this time, the gate drive circuit GOA has no output, so the output detection circuit 210 outputs the first enable signal OS at a low level, and after the first enable signal OS and the second enable signal TD pass the logic circuit 230, i.e., the OR gate, the logic circuit 230 outputs the third enable signal CS at a high level. At this time, the third switch transistor M3 is turned off, the second switch transistor M2 is turned on, and the standard gate turn-on voltage signal VGH (e.g., 22V) enters the boost circuit 241, and is boosted to the higher gate turn-on voltage signal VGHH (e.g., 26V). At this time, the higher gate turn-on voltage signal VGHH (e.g., 26V) enters the level conversion circuit 300, and thereafter all the clock signals CLK1_G, and CLK2_G, the high-level signal VGH_G, and the frame start signal STV_G are boosted, and then enters the gate drive circuit GOA, so the gate drive signal at the higher voltage turns on the Thin Film Transistor (TFT) in the gate drive circuit GOA completely at low temperature, and enables a PU/PD point of the gate drive circuit GOA to operate normally at low temperature.

In a second stage t2, the output at the last row of gate drive circuit GOA is fed to the output detection circuit 210 after scanning with a frame of frame start signal STV_G is completed, and if the output is abnormal, then the output detection circuit 210 will output the first enable signal OS at a high level to the logic circuit 230, and the logic circuit 230 will continue to output the third enable signal CS at a high level; and at this time, the third switch transistor M3 is turned off, the second switch transistor M2 is turned on, and the standard gate turn-on voltage signal VGH (e.g., 22V) enters the boost circuit 241, and is boosted to the higher gate turn-on voltage signal VGHH (e.g., 26V). If the output detection circuit 210 detects the normal output at the last row of gate drive circuit GOA, then the output detection circuit will output the first enable signal OS at a low level to the logic circuit 230, and if the second enable signal TD is output at a low level, then the third enable signal CS will be at a low level; and at this time, the second switch transistor M2 is turned off, the third enable signal CS at a low level passes the inverter 242, and then turns on the third switch transistor M3, the standard gate turn-on voltage signal VGH (e.g., 22V) enters the level conversion circuit 300 directly, and both the control circuit 200 and the gate drive circuit GOA operate in a low power consumption state.

In a third stage t3, when the temperature detection circuit 220 detects that the ambient temperature is above −20□, the second enable signal TD is at a low level, and the output detection circuit 210 detects the abnormal output at the last row of gate drive circuit GOA, after scanning with a frame is completed, so the first enable signal OS is output at a high level; and at this time, the logic circuit 230 outputs the third enable signal CS at a high level. In this stage, abnormal startup due to an inherent difference of the display panel approaching the critical temperature (−20° C.) can be prevented.

In a fourth stage t4, when the temperature detection circuit 220 detects that the ambient temperature is above −20□, the second enable signal TD is at a low level, and the output detection circuit 210 detects the normal output at the last row of gate drive circuit GOA, after scanning with a frame is completed, so the first enable signal OS is output at a low level; and at this time, the logic circuit 230 outputs the third enable signal CS at a low level. At this time, the standard gate turn-on voltage signal VGH (e.g., 22V) enters the level conversion circuit 300 directly, and both the control circuit 200 and the gate drive circuit GOA operate in a low power consumption state.

Figure 7:
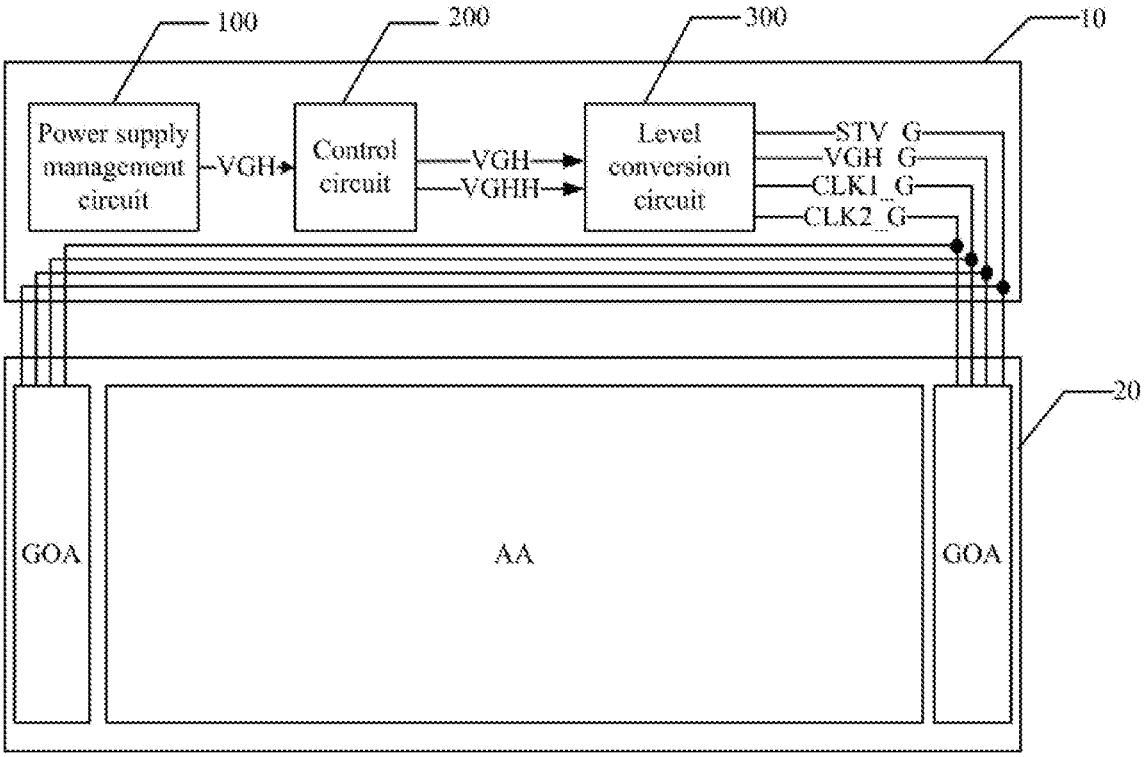
FIG. 7 is a schematic structural diagram of a display device according to the embodiments of the disclosure.

Based upon the same inventive concept, the embodiments of the disclosure further provides a display device, as illustrated in FIG. 7, the display device includes: the display drive circuit 10 above according to the embodiments of the disclosure, and a display panel 20 including a gate drive circuit GOA.

In some embodiments, the display device can be a mobile phone, a tablet computer, a TV set, a monitor, a notebook computer, a digital photo frame, a navigator, or any other product or component with a display function. And reference can be made to the embodiments of the display drive circuit above for an implementation of the display device, so a repeated description thereof will be omitted here.

In some embodiments, the display panel 20 can be an Organic Light-Emitting Diode (OLED) display panel, or can be a Liquid Crystal Display (LCD) panel, or can be another flat display panel including a gate drive circuit GOA. Furthermore the gate drive circuit GOA can be arranged on one or two sides of a display area AA of the display panel 20, although the embodiments of the disclosure will not be limited thereto.

Based upon the same inventive concept, the embodiments of the disclosure further provide a method for driving the display device above, where the method includes following operations.

The display drive circuit 10 determines whether the ambient temperature is below the set temperature, and determines whether the gate drive circuit GOA of the display panel 20 is outputting normally.

The display drive circuit 10 generates the gate drive signal at the standard voltage according to the standard gate turn-on voltage signal, and outputs the gate drive signal at standard voltage to the gate drive circuit GOA of the display panel 20, upon determining that the ambient temperature is not below the set temperature, and the gate drive circuit GOA of the display panel 20 is outputting normally.

The display drive circuit 10 boosts the standard gate turn-on voltage signal, and generates the higher gate turn-on voltage signal; and generates the gate drive signal at the higher voltage according to the higher gate turn-on voltage signal, and outputs the gate drive signal at the higher voltage to the gate drive circuit GOA of the display panel 20, upon determining that the ambient temperature is below the set temperature, and/or the gate drive circuit GOA of the display panel is outputting abnormally.

In the display drive circuit, the display device and the method for driving the same above according to the embodiments of the disclosure, the control circuit is further arranged between the power supply management circuit and the level conversion circuit, and the control circuit boosts the standard gate turn-on voltage signal provided by the power supply management circuit, and generates and then outputs the higher gate turn-on voltage signal to the level conversion circuit, upon determining that the ambient temperature is below the set temperature, and/or the output of the gate drive circuit of the display panel is abnormal, so that the level conversion circuit generates and then outputs the corresponding gate drive signal at the higher voltage, and in this way, when the detection result shows that the gate drive circuit is operating in a harsh low-temperature environment, the drive voltage of the gate drive circuit is raised so that it can be started and operate normally to thereby enable the display panel to operate normally. The control circuit outputs the standard gate turn-on voltage signal provided by the power supply management circuit to the level conversion circuit directly upon determining that the ambient temperature is not below the set temperature, and the gate drive circuit of the display panel is outputting normally, so that the level conversion circuit generates and then outputs the corresponding gate drive signal at the standard voltage, and in this way, when the detection result shows that the gate drive circuit is operating normally, the gate drive circuit is brought into operation at the drive voltage with lower power consumption to thereby save power consumption in normal operation. Thus power consumption of the display panel can be saved while guaranteeing normal startup at the low temperature.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A display drive circuit, comprising: a power supply management circuit, a control circuit connected with the power supply management circuit, and a level conversion circuit connected with the control circuit, wherein:

the power supply management circuit is configured to provide a standard gate turn-on voltage signal;

the control circuit is configured to output a received standard gate turn-on voltage signal directly upon determining that an ambient temperature is not below a set temperature, and a gate drive circuit of a display panel is outputting normally; or to boost the received standard gate turn-on voltage signal, and to generate and then output a higher gate turn-on voltage signal, upon determining that the ambient temperature is below the set temperature, and/or the gate drive circuit of the display panel is outputting abnormally; and the level conversion circuit is configured to generate and then output a gate drive signal at standard voltage upon reception of the standard gate turn-on voltage signal; or to generate and then output a gate drive signal at higher voltage upon reception of the higher gate turn-on voltage signal.

2. The display drive circuit according to claim 1, wherein the control circuit comprises: an output detection circuit, a temperature detection circuit, a logic circuit connected respectively with the output detection circuit and the temperature detection circuit, and a boost judgment circuit connected respectively with the logic circuit, the power supply management circuit and the level conversion circuit, wherein:

the output detection circuit is configured to output a first enable signal at a first level upon detecting an abnormal output of the gate drive circuit of the display panel; or to output a first enable signal at a second level upon detecting a normal output of the gate drive circuit of the display panel;

the temperature detection circuit is configured to output a second enable signal at the first level upon detecting that the ambient temperature is below the set temperature; or to output a second enable signal at the second level upon detecting that the ambient temperature is not below the set temperature;

the logic circuit is configured to output a third enable signal at the first level upon reception of the first enable signal at the first level and/or the second enable signal at the first level; or to output a third enable signal at the second level upon reception of the first enable signal at the second level and the second enable signal at the second level; and the boost judgment circuit is configured to output the received standard gate turn-on voltage signal directly upon reception of the third enable signal at the second level; or to boost the received standard gate turn-on voltage signal, and to generate and then output the higher gate turn-on voltage signal upon reception of the third enable signal at the first level.

3. The display drive circuit according to claim 2, wherein the temperature detection circuit comprises: a first resistor, a second resistor, a thermistor, and a first switch transistor, wherein:

one terminal of the first resistor is connected with a power supply signal terminal, and the other terminal of the first resistor is connected with a first node;

one terminal of the second resistor is connected with the first node, and the other terminal of the second resistor is grounded;

one terminal of the thermistor is connected with the first node, and the other terminal of the thermistor is connected with a gate of the first switch transistor;

a source of the first switch transistor is connected with the power supply signal terminal, and a drain of the first switch transistor is connected with the logic circuit; and the first level is a high level, and the second level is a low level; and a resistance of the thermistor decreases as a temperature decreases.

4. The display drive circuit according to claim 2, wherein the logic circuit comprises: a first diode, a second diode, and a third resistor, wherein:

an input terminal of the first diode is connected with the temperature detection circuit, and an output terminal of the first diode is connected with the boost judgment circuit;

an input terminal of the second diode is connected with the output detection circuit, and an output terminal of the second diode is connected with the boost judgment circuit; and one terminal of the third resistor is connected respectively with the output terminal of the first diode and the output terminal of the second diode, and the other terminal of the third resistor is grounded.

5. The display drive circuit according to claim 2, wherein the boost judgment circuit comprises: a second switch transistor, a third switch transistor, and a boost circuit, wherein:

a gate of the second switch transistor is connected with the logic circuit, a source of the second switch transistor is connected with the power supply management circuit, and a drain of the second switch transistor is connected with an input terminal of the boost circuit, and an output terminal of the boost circuit is connected with the level conversion circuit;

a gate of the third switch transistor is connected with the logic circuit, a source of the third switch transistor is connected with the power supply management circuit, and a drain of the third switch transistor is connected with the level conversion circuit; and the first level is a low level, the second level is a high level, the second switch transistor is a P-type transistor, and the third switch transistor is an N-type transistor; or the first level is a high level, the second level is a low level, the second switch transistor is an N-type transistor, and the third switch transistor is a P-type transistor.

6. The display drive circuit according to claim 2, wherein the boost judgment circuit comprises: a second switch transistor, a third switch transistor, an inverter, and a boost circuit, wherein:

a gate of the second switch transistor is connected with the logic circuit, a source of the second switch transistor is connected with the power supply management circuit, and a drain of the second switch transistor is connected with an input terminal of the boost circuit, and an output terminal of the boost circuit is connected with the level conversion circuit; and a gate of the third switch transistor is connected with an output terminal of the inverter, a source of the third switch transistor is connected with the power supply management circuit, and a drain of the third switch transistor is connected with the level conversion circuit, and an input terminal of the inverter is connected with the logic circuit.

7. The display drive circuit according to claim 6, wherein the inverter comprises: a fourth switch transistor and a fifth switch transistor, wherein:

a gate of the fourth switch transistor and a gate of the fifth switch transistor are connected respectively with the logic circuit;

a source of the fourth switch transistor is connected with the power supply signal terminal, and a drain of the fourth switch transistor is connected with the gate of the third switch transistor;

a source of the fifth switch transistor is grounded, and a drain of the fifth switch transistor is connected with the gate of the third switch transistor; and the fourth switch transistor is a P-type transistor, and the fifth switch transistor is an N-type transistor.

8. The display drive circuit according to claim 2, wherein the display drive circuit further comprises a timing controller in which the output detection circuit is arranged; and the timing controller is connected with an output terminal at a last level of the gate drive circuit of the display panel.

9. The display drive circuit according to claim 1, wherein each gate drive signal includes at least one of a clock signal, a high-level signal, and a frame start signal.

10. A display device, comprising a display drive circuit, and a display panel comprising a gate drive circuit, wherein the display drive circuit comprises a power supply management circuit, a control circuit connected with the power supply management circuit, and a level conversion circuit connected with the control circuit, wherein:

the power supply management circuit is configured to provide a standard gate turn-on voltage signal;

the control circuit is configured to output a received standard gate turn-on voltage signal directly upon determining that an ambient temperature is not below a set temperature, and a gate drive circuit of a display panel is outputting normally; or to boost the received standard gate turn-on voltage signal, and to generate and then output a higher gate turn-on voltage signal, upon determining that the ambient temperature is below the set temperature, and/or the gate drive circuit of the display panel is outputting abnormally; and the level conversion circuit is configured to generate and then output a gate drive signal at standard voltage upon reception of the standard gate turn-on voltage signal; or to generate and then output a gate drive signal at higher voltage upon reception of the higher gate turn-on voltage signal.

11. The display device according to claim 10, wherein the control circuit comprises: an output detection circuit, a temperature detection circuit, a logic circuit connected respectively with the output detection circuit and the temperature detection circuit, and a boost judgment circuit connected respectively with the logic circuit, the power supply management circuit and the level conversion circuit, wherein:

the output detection circuit is configured to output a first enable signal at a first level upon detecting an abnormal output of the gate drive circuit of the display panel; or to output a first enable signal at a second level upon detecting a normal output of the gate drive circuit of the display panel;

the temperature detection circuit is configured to output a second enable signal at the first level upon detecting that the ambient temperature is below the set temperature; or to output a second enable signal at the second level upon detecting that the ambient temperature is not below the set temperature;

the logic circuit is configured to output a third enable signal at the first level upon reception of the first enable signal at the first level and/or the second enable signal at the first level; or to output a third enable signal at the second level upon reception of the first enable signal at the second level and the second enable signal at the second level; and the boost judgment circuit is configured to output the received standard gate turn-on voltage signal directly upon reception of the third enable signal at the second level; or to boost the received standard gate turn-on voltage signal, and to generate and then output the higher gate turn-on voltage signal upon reception of the third enable signal at the first level.

12. The display device according to claim 11, wherein the temperature detection circuit comprises: a first resistor, a second resistor, a thermistor, and a first switch transistor, wherein:

one terminal of the first resistor is connected with a power supply signal terminal, and the other terminal of the first resistor is connected with a first node;

one terminal of the second resistor is connected with the first node, and the other terminal of the second resistor is grounded;

one terminal of the thermistor is connected with the first node, and the other terminal of the thermistor is connected with a gate of the first switch transistor;

a source of the first switch transistor is connected with the power supply signal terminal, and a drain of the first switch transistor is connected with the logic circuit; and the first level is a high level, and the second level is a low level; and a resistance of the thermistor decreases as a temperature decreases.

13. The display device according to claim 11, wherein the logic circuit comprises: a first diode, a second diode, and a third resistor, wherein:

an input terminal of the first diode is connected with the temperature detection circuit, and an output terminal of the first diode is connected with the boost judgment circuit;

an input terminal of the second diode is connected with the output detection circuit, and an output terminal of the second diode is connected with the boost judgment circuit; and one terminal of the third resistor is connected respectively with the output terminal of the first diode and the output terminal of the second diode, and the other terminal of the third resistor is grounded.

14. The display device according to claim 11, wherein the boost judgment circuit comprises: a second switch transistor, a third switch transistor, and a boost circuit, wherein:

a gate of the second switch transistor is connected with the logic circuit, a source of the second switch transistor is connected with the power supply management circuit, and a drain of the second switch transistor is connected with an input terminal of the boost circuit, and an output terminal of the boost circuit is connected with the level conversion circuit;

a gate of the third switch transistor is connected with the logic circuit, a source of the third switch transistor is connected with the power supply management circuit, and a drain of the third switch transistor is connected with the level conversion circuit; and the first level is a low level, the second level is a high level, the second switch transistor is a P-type transistor, and the third switch transistor is an N-type transistor; or the first level is a high level, the second level is a low level, the second switch transistor is an N-type transistor, and the third switch transistor is a P-type transistor.

15. The display device according to claim 11, wherein the boost judgment circuit comprises: a second switch transistor, a third switch transistor, an inverter, and a boost circuit, wherein:

a gate of the second switch transistor is connected with the logic circuit, a source of the second switch transistor is connected with the power supply management circuit, and a drain of the second switch transistor is connected with an input terminal of the boost circuit, and an output terminal of the boost circuit is connected with the level conversion circuit; and a gate of the third switch transistor is connected with an output terminal of the inverter, a source of the third switch transistor is connected with the power supply management circuit, and a drain of the third switch transistor is connected with the level conversion circuit, and an input terminal of the inverter is connected with the logic circuit.

16. The display device according to claim 15, wherein the inverter comprises: a fourth switch transistor and a fifth switch transistor, wherein:

a gate of the fourth switch transistor and a gate of the fifth switch transistor are connected respectively with the logic circuit;

a source of the fourth switch transistor is connected with the power supply signal terminal, and a drain of the fourth switch transistor is connected with the gate of the third switch transistor;

a source of the fifth switch transistor is grounded, and a drain of the fifth switch transistor is connected with the gate of the third switch transistor; and the fourth switch transistor is a P-type transistor, and the fifth switch transistor is an N-type transistor.

17. The display device according to claim 11, wherein the display drive circuit further comprises a timing controller in which the output detection circuit is arranged; and the timing controller is connected with an output terminal at a last level of the gate drive circuit of the display panel.

18. The display device according to claim 10, wherein each gate drive signal includes at least one of a clock signal, a high-level signal, and a frame start signal.

19. A method for driving the display device according to claim 10, the method comprising:

determining, by the display drive circuit, whether the ambient temperature is below the set temperature, and determining whether the gate drive circuit of the display panel is outputting normally;

generating, by the display drive circuit, the gate drive signal at the standard voltage according to the standard gate turn-on voltage signal, and outputting the gate drive signal at the standard voltage to the gate drive circuit of the display panel, upon determining that the ambient temperature is not below the set temperature, and the gate drive circuit of the display panel is outputting normally; or boosting, by the display drive circuit, the standard gate turn-on voltage signal, and generating the higher gate turn-on voltage signal; and generating the gate drive signal at the higher voltage according to the higher gate turn-on voltage signal, and outputting the gate drive signal at the higher voltage to the gate drive circuit of the display panel, upon determining that the ambient temperature is below the set temperature, and/or the gate drive circuit of the display panel is outputting abnormally.

* * * * *